US009649680B2

(12) United States Patent
Frehe et al.

(10) Patent No.: US 9,649,680 B2
(45) Date of Patent: May 16, 2017

(54) METHOD FOR PRODUCING METAL EXTRUSION PRESS PRODUCTS, AND EXTRUSION AND TUBE PRESS

(71) Applicants: Stephan Frehe, Erkrath (DE); Andreas Wershofen-Crombach, Moenchengladbach (DE); Uwe Muschalik, Duisburg (DE); Cornelio Lioni, Duesseldorf (DE)

(72) Inventors: Stephan Frehe, Erkrath (DE); Andreas Wershofen-Crombach, Moenchengladbach (DE); Uwe Muschalik, Duisburg (DE); Cornelio Lioni, Duesseldorf (DE)

(73) Assignee: SMS MEER GMBH, Moenchengladbach (DE)

( * ) Notice: Subject to any disclaimer, the term of this patent is extended or adjusted under 35 U.S.C. 154(b) by 18 days.

(21) Appl. No.: 14/129,179

(22) PCT Filed: Oct. 31, 2012

(86) PCT No.: PCT/EP2012/004553
§ 371 (c)(1),
(2) Date: Dec. 24, 2013

(87) PCT Pub. No.: WO2013/064250
PCT Pub. Date: May 10, 2013

(65) Prior Publication Data

US 2015/0040635 A1 Feb. 12, 2015

(30) Foreign Application Priority Data

Oct. 31, 2011 (DE) ..... 10 2011 117 276

(51) Int. Cl.
*B21C 23/21* (2006.01)

(52) U.S. Cl.
CPC ..... *B21C 23/212* (2013.01); *B21C 23/211* (2013.01); *B21C 23/215* (2013.01); *B21C 23/217* (2013.01)

(58) Field of Classification Search
CPC ..... B21C 23/21; B21C 23/211; B21C 23/212; B21C 23/217; B30B 13/00; B30B 11/02;
(Continued)

(56) References Cited

U.S. PATENT DOCUMENTS 2,210,284 A * 8/1940 Dinzl ..... B30B 15/16 409/245
3,127,014 A * 3/1964 Dohrn ..... B21C 23/21 72/255

(Continued)

FOREIGN PATENT DOCUMENTS

CN 2805966 Y 8/2006
CN 101327495 A 12/2008

(Continued)

*Primary Examiner* — James S McClellan
*Assistant Examiner* — Peter Iannuzzi
(74) *Attorney, Agent, or Firm* — Andrew Wilford

(57) ABSTRACT

The invention relates to extrusion and pipe presses (1), comprising a press frame consisting of a cylindrical spar (2) and a counter spar (4) connected thereto, in which a mobile billet container holder (7) supporting a billet container (8), which puts a billet (18) to be pressed, which was introduced by a loading device, into a press position in front of the counter spar (4) with the associated tool (38), and a mobile punch crosshead (6) are provided. In the cylindrical spar (2), a main cylinder, or press cylinder, is arranged, which in the cylinder housing (9) thereof receives a press piston (11), which at the front end thereof that is supported by the punch crosshead (6) is connected to a press punch (19). A compensation tank (15), which delivers hydraulic oil to the press piston (11) by way of a slider plate (28), is assigned to a main cylinder housing (9) connected to a tank line. With an (Continued)

extrusion press such as this, the considerable hydraulic expenditure, and in particular the non-productive time, are to be substantially reduced, while making the structural design more compact and simple at the same time. To accomplish this, the advancing and feed motions of the billet container holder (7) and punch crosshead (6) with press piston (11) are carried out by electromotive force, and both the precompression of the billet (18) loaded into the billet container (8) and the subsequent compression of the billet (18) are done by hydraulic loading of the press piston (11). Electric motors (12, 13) are assigned to the punch crosshead (6) and the billet container holder (7) as adjustment drives. A large-scale filling valve (20) is integrated in the cylinder housing (9) of the main cylinder for loading the press piston (11).

9 Claims, 13 Drawing Sheets

(58) Field of Classification Search
CPC ..... B30B 11/027; B30B 11/04; B30B 15/02; B30B 15/16; B30B 15/18; B30B 15/24; B30B 15/22
USPC ..... 72/28.1, 29.2, 253.1, 271–273, 453.01, 72/453.14
See application file for complete search history.

(56) References Cited

U.S. PATENT DOCUMENTS

| | | | | |
|---|---|---|---|---|
| 3,182,479 | A | 5/1965 | Rosenthal | |
| 3,802,238 | A * | 4/1974 | Grant | B21C 23/212 72/263 |
| 4,084,422 | A | 4/1978 | Zilges et al. | |
| 4,206,626 | A | 6/1980 | Groos et al. | |
| 6,082,162 | A | 7/2000 | Muschalik et al. | |
| 7,216,522 | B2 | 5/2007 | Gala | |
| 7,421,874 | B2 | 9/2008 | Claasen | |
| 2005/0252267 | A1 | 11/2005 | Gala | |
| 2006/0101886 | A1 | 5/2006 | Claasen et al. | |
| 2010/0000283 | A1 * | 1/2010 | Yamamoto | B21C 23/08 72/272 |
| 2010/0080526 | A1 | 4/2010 | Sumi et al. | |
| 2012/0244239 | A1 * | 9/2012 | Yamamoto | B21C 23/211 425/258 |

FOREIGN PATENT DOCUMENTS

| | | | |
|---|---|---|---|
| EP | 0822017 | A | 2/1998 |
| JP | 2007160335 | A | 6/2007 |

* cited by examiner

METHOD FOR PRODUCING METAL EXTRUSION PRESS PRODUCTS, AND EXTRUSION AND TUBE PRESS

CROSS REFERENCE TO RELATED APPLICATIONS

This application is the U.S.-national stage of PCT application PCT/EP2012/004553 filed 31 Oct. 2012 and claiming the priority of German patent application 102011117276.2 itself filed 31 Oct. 2011.

The invention relates to a method of making metallic extrusions with an extrusion/tube press comprising a press frame consisting of a cylinder housing and a counter housing connected thereto, a mobile billet support therein supporting a billet holder that sets a billet to be pressed, which was introduced by a loader, into a press position in front of the counter housing with a tool, and a mobile punch crosshead, a main or press cylinder being provided in the cylinder housing and holding at a front end a press piston that is supported by the punch crosshead connected to a press punch, and a compensation tank that supplies hydraulic fluid to the press piston by the slide plate being provided for a main cylinder connected to a reservoir line that supplies hydraulic fluid to the press piston by a slide plate. The invention further relates to an extrusion/tube press and/or metal extrusion presses for implementing the method.

An extrusion press of this type where the counter housing, which includes the tool, usually the pressure plate, female die holder and die, and connected to the cylinder beam by tie rods and/or tension beams as well as compression beams is known from DE 102 27 488 [U.S. Pat. No. 7,216,522]. Furthermore, EP 1 526 930 [U.S. Pat. No. 7,421,874] also discloses a metal extrusion press with a compensation tank that is mounted on the main cylinder for supplying hydraulic fluid under pressure to the press piston and/or plunger.

To achieve a high level of efficiency of the presses, nonproductive times must be minimized; in particular, the displacement and lateral cylinders that are provided for the billet support, inside which are disposed the billet holder and/or recipient, and the punch crosshead and/or mobile spar must be able to handle idling and retraction at optimum speeds. To this end, large flow volumes must be moved between the cylinders and the oil tank at high flow rates, resulting in turbulent flow and, consequently, foaming due to air trapped in the oil. These disadvantageous operating conditions can only be counteracted by implementing measures of great complexity.

In a frameless metal extrusion press, as disclosed in EP 0 822 017, the handling of large flow volumes is achieved in that two or more press pistons are envisioned that are provided with piston rods of the same diameter traversing their cylinders at both ends, and that the piston rods are sealed on both sides relative to the cylinders, such that cylinder-type partial chambers with areas of equal effectiveness are present on both faces. These are connected to each other by a short-circuited line via a switchable locking valve that can be closed during the working stroke. Special piston drive cylinders are provided for a fast return stroke and high-speed advance on this press. The short-circuited line that connects the cylinder chambers on both sides of the press piston allows for a quick transfer of the oil from side of the cylinder to the other and with minimal flow resistance, where, however, the short-circuited lines and the switchable locking valves therein must be quite large.

Therefore, it is the underlying object of the present invention to propose a method and an extrusion/tube press of the type specified above that does not suffer from the disadvantages described above; in particular, as one task, the present invention seeks to reduce the hydraulic complexity as well as nonproductive times while simultaneously providing a compact, simple construction of the extrusion/tube press and/or metal extrusion press.

According to the invention, this object is achieved in that the traveling and feeding movements of the billet support and the punch crosshead are implemented by electromotive means with press pistons, and in that precompressing of the billet that is loaded in the billet holder and the subsequent press step of the billet are performed by applying a force hydraulically to the press piston. This allows, for example, for a type of operation that involves the targeted interaction between electromotive and hydraulic drives. The billet support and the punch crosshead and/or the traveling beam with the press piston are indeed moved by the electric motors, preferably servo motors, particularly at high accelerations and speeds, while it is also possible to ensure exact stop positioning. This way, it is possible to reduce the nonproductive times with regard to the movements that are necessary in preparation of the actual press process to a value below 13.8 s.

As soon as the billet support and the press piston have been moved into their end positions, the electromotive drive is deactivated, and the apparatus is switched to hydraulic operation. This way, this hydraulic operation is able to generate the high forces that are needed for the press piston to press and thus extrude the loaded billet with the forces that are required for the sealing press-on action of the billet support and/or billet holder against the tool, also for generating a stripping force in order to be able to expose an end piece of the extrusion that has a certain length or the extrusion butt by retracting the billet support for the purpose of separating the butt. Since hydraulics are no longer used for achieving the traveling movements, it is now possible to considerably reduce the required tank volume from ca. 10,000 liters to date to only approximately 400 liters, thereby realizing, moreover, an enormous cost reduction with regard to the hydraulic system in that the required tube lines weigh substantially less (ca. 35%). The reservoir in use until now had a large volume, which made it bulky; such a reservoir no longer needs to be mounted above the main cylinder; instead, the reservoir can now be placed is next to the extrusion press and can be connected thereto by hoses. Due to the use of now only minimal oil volumes, it is possible to use smaller pumps and valves that are smaller by two of the previous nominal orders of magnitude. Moreover, it is no longer necessary to generate a cooling power of approximately 160 KW; instead, a cooling power of approximately 40 KW is sufficient. The previously mentioned comparison values were obtained based on a conventional 25/27 MN standard press.

According to a preferred mode of operation, it is proposed according to the invention that the billet support and the punch crosshead, including the press piston, are moved simultaneously and jointly by an electric motor or actuator in the press direction in order to clamp the loaded billet between the press punch and the tool, with a first quantity of hydraulic fluid being pressed from the compensation tank into the main cylinder behind the press piston via an opened filling valve that is integrated in the main cylinder, that, after the clamping action of the billet, only the billet support travels further via electromotive means until the billet traversed by the billet support is completely clamped in the billet holder, and whereupon, for the purpose of precompressing the billet, a drive cylinder that is flange-mounted to the rear wall of the compensation tank has a load applied thereto, with a second quantity of hydraulic fluid being pressed via the opened filling valve to behind the press piston, and that the pressing action of the billet is performed with a closed filling valve by applying a hydraulic fluid load to the rear end of the press piston from a reservoir, with a third quantity of hydraulic fluid being pressed in a parallel fashion relative to the former step from the compensation tank into the reservoir. While the required circulating volume of ca. 1500 liters was required in the known metal extrusion press with compensation tank, according to the present invention, only approximately 45 liters are needed. The tank therein is always evenly filled. The amount of oil that is supplied behind the press piston, which is preferably guided by hydrostatic support inside the cylinder, is conveyed correspondingly from the compensation tank into the reservoir.

According to one embodiment of the present invention, in order to strip the extrusion butt, the billet support is hydraulically retracted for a short distance that corresponds to the length of the extrusion butt. The extrusion butt thereby protrudes from the billet holder and can thus be separated, usually by shears for cutting off this extrusion butt.

According to the invention, it is presently proposed that, after the completed press process, the billet support and the punch crosshead with the press piston are retracted by electromotive means while the filling valve is open, into the starting position for reloading another billet that is to be pressed. The small circulating volume is thereby returned to the compensation tank and is now available for a new press process.

The underlying object of the present invention is achieved by an extrusion/tube press and/or metal extrusion press according to the invention of the specified class in that electric motors, preferably servo motors, are provided for the punch crosshead and the billet support serving as adjustment drives, and the press piston is connected by stem that extends inside the compensation tank to a hydraulically loaded drive cylinder that is fastened to the outside on the rear wall of the compensation tank for precompressing the loaded billet, and that the stem is configured with a filling valve that is integrated in the transition from the compensation tank to the main cylinder, adjusted to the internal diameter of the cylinder and opening a large annular flow cross-section when it is in the open position. The travel movements and/or the closure movements, including clamping and traveling over the billet for inserting it into the receptacle of the billet support, is handled by electric motors. The drive cylinder is actuated for the precompressing and/or compressing operation of the billet while the filling valve is open; and the drive cylinder is thus used for generating the compression force. After the compressing and/or precompressing operation, the filling valve is closed; only a small quantity of hydraulic fluid is needed and supplied via the pressure-oil line from the reservoir into the cylinder chamber behind the press piston.

One proposal according to the invention provides for one electric motor on each of the longitudinal sides of the billet support and the punch crosshead that advantageously engage with gear racks via drive sprockets. Optionally, threaded spindle arrangements and/or threaded roller drives are good solutions for drive power that can move the billet support and the punch crosshead into the press position.

According to one preferred embodiment of the invention, the stem that connects the press piston with the drive cylinder consists, on the one hand, of an outer tube that is mounted inside the press piston and carries on its opposite free end a slide plate and also a drive rod that extends inside the outer tube, the engaged end of the drive rod being configured with a clamp that must be temporarily pressed against the outer tube. The concentric nesting of the drive rod and the outer tube makes it possible to combine these parts, if necessary, into a rigid unit, particularly by the clamp, which can include a central cone, according to one proposed aspect of the invention, and that presses complementary wedges against the interior walls of the tube when a load is applied to the drive cylinder for purposes of compressing and/or precompressing the billet. Alternately, it is also possible to use a hydraulic clamping stage. In the clamped state, the slide plate that is mounted on the outer tube is linearly displaced in the compensation tank and supplies a quantity of the hydraulic fluid, taken up in the compensation cylinder, to behind the press piston. Without clamping actuation, as with a drive cylinder switched over for pressing the billet, the outer tube is displaced when the filling valve is closed, with the stroke of the press piston that is loaded via the reservoir by conveying through pumping, correspondingly, relative to the stationary drive rod in a forward direction, and the slide plate displaces oil volume into the reservoir.

One proposed aspect of the invention provides that the drive cylinder is configured such that, when the clamp is activated, the force for compressing the billet is generated by the drive rod. The drive cylinder thus has a dual function; namely, actuating the clamp and generating the compression force.

According to one preferred embodiment of the invention, the filling valve has a valve body that is disposed on the outer tube over a collar-like slide bushing that is enclosed in the pressing direction by a ring cylinder behind the valve body; and the ring piston brings the slide bushing and thereby the valve cover, dependent on which piston side that is pressurized with hydraulic fluid, in the closing position or in the opening position. Therefore, depending on the need as it exists at a given time, meaning depending on the respective operating phase, the filling valve can be opened via the ring cylinder, as when advancing the billet support and the punch crosshead, or the filling valve can be closed, as when the pressing action following the precompression step takes place. When in the opening function, the free and large annular flow cross-section provides an unimpeded, free-flowing passage for the volume of oil that is pressed either from the compensation tank into the pressure chamber of the press piston cylinder or, after the press step, by the retracting press piston back into the compensation tank.

According to a further embodiment of the invention, at least one support rod is provided for the billet support on each longitudinal side, which is free to move in the longitudinal direction through the cylinder housing, the tension rods being enclosed by a combined ring cylinder and clamp along part of the distance between the cylinder housing and the billet support. These combined units allow for the support rods to be taken along without impediment with any advancing and/or traveling movements of the billet supports, achieved by the electric motors. The clamping function is activated in order to achieve a sealing action, when in the press position, by the billet support against the tool set of the counter housing. These units are also used for removing the extrusion butt; in particular, in that the pressure in the ring cylinder is switched to the other side, such that the billet support is removed and/or retracted somewhat, counter to the press direction of the billet support, from the tool set. The clamp can in this instance also be configured as a mechanical or hydraulic means, for example with clamping cushions, or the like.

Further details and characteristics of the present invention can be derived from the claims and the subsequent embodiments as shown in the context of the drawings. Shown are as follows:

Figure 1:
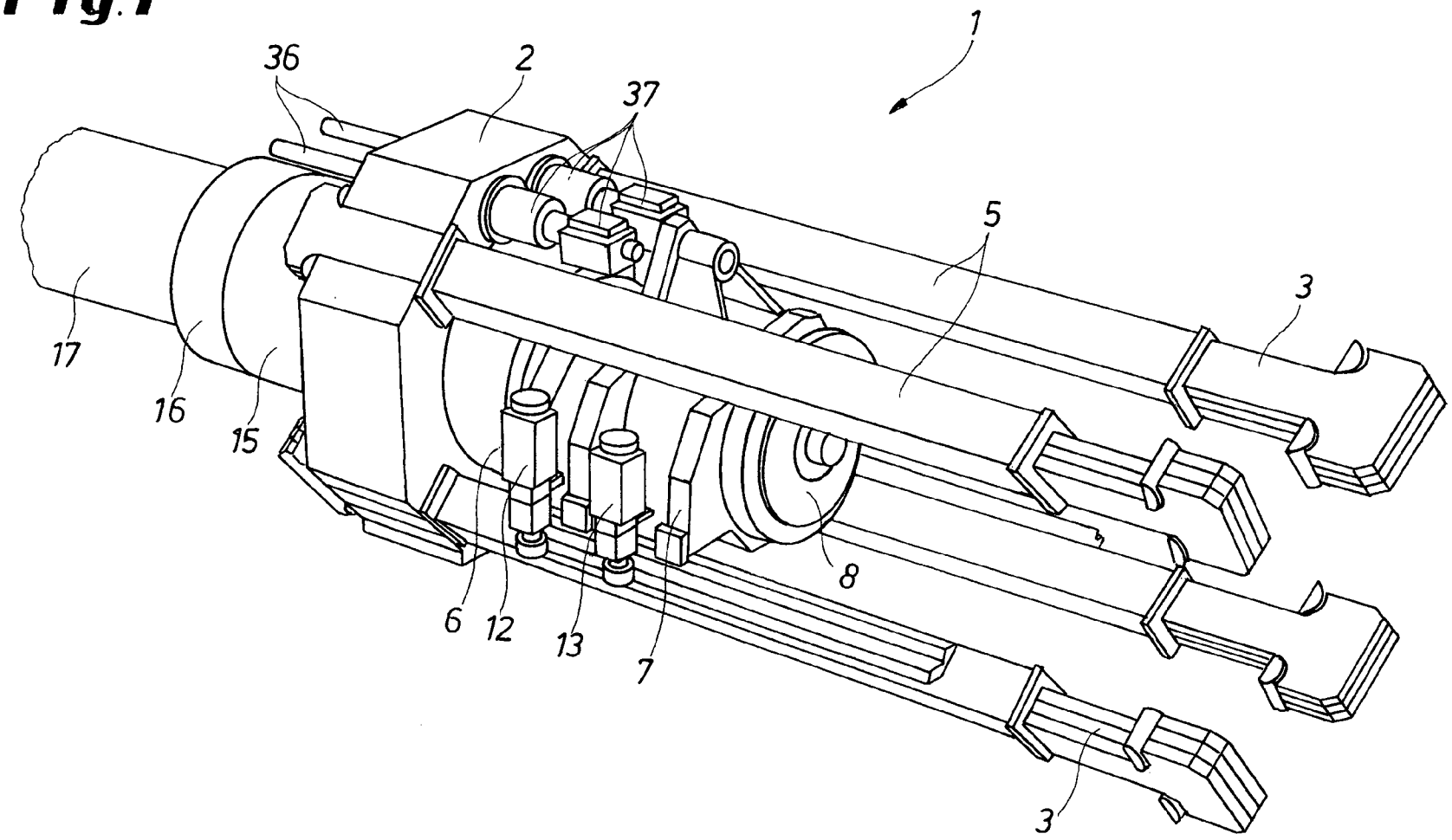
FIG. 1 is a perspective view of a detail of an extrusion/tube and/or metal extrusion press, including a press frame with a punch crosshead and billet support therein.
Figure 8A:
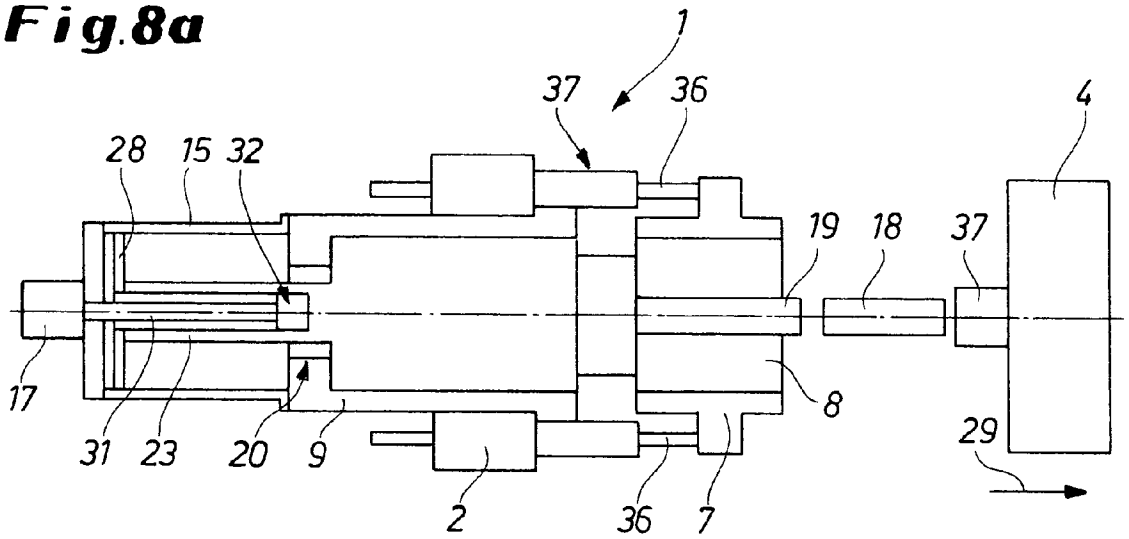
Figure 8B:
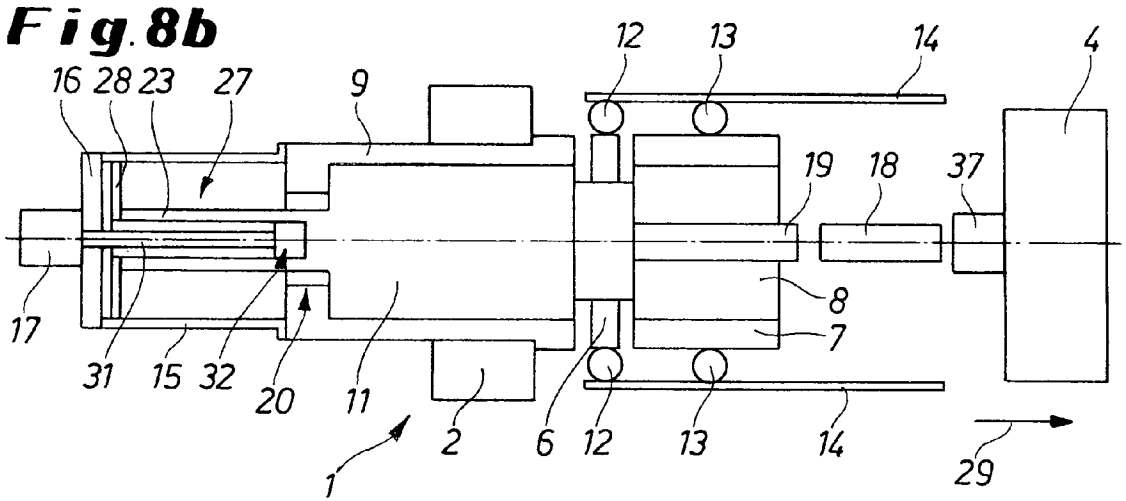
Figure 9A:
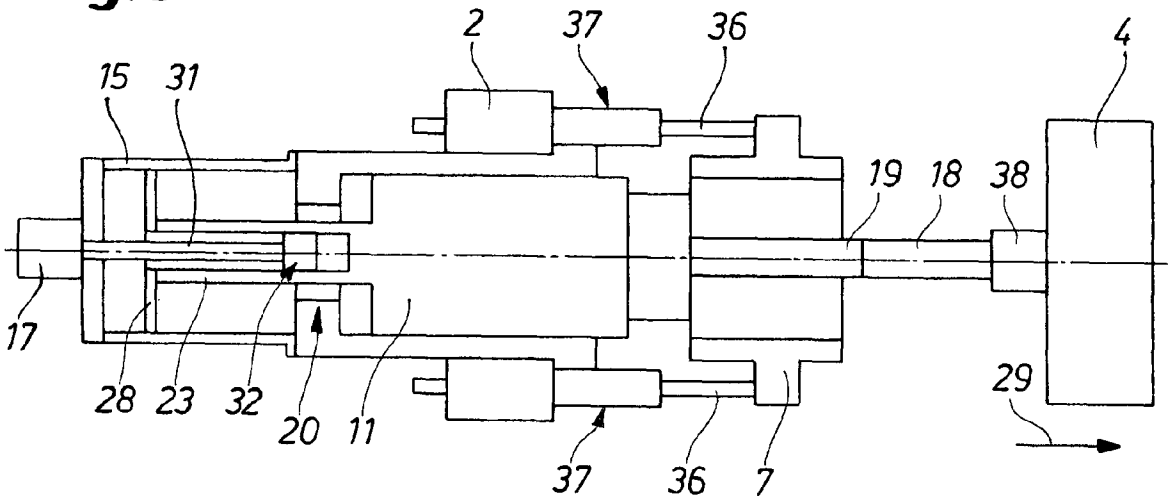
Figure 9B:
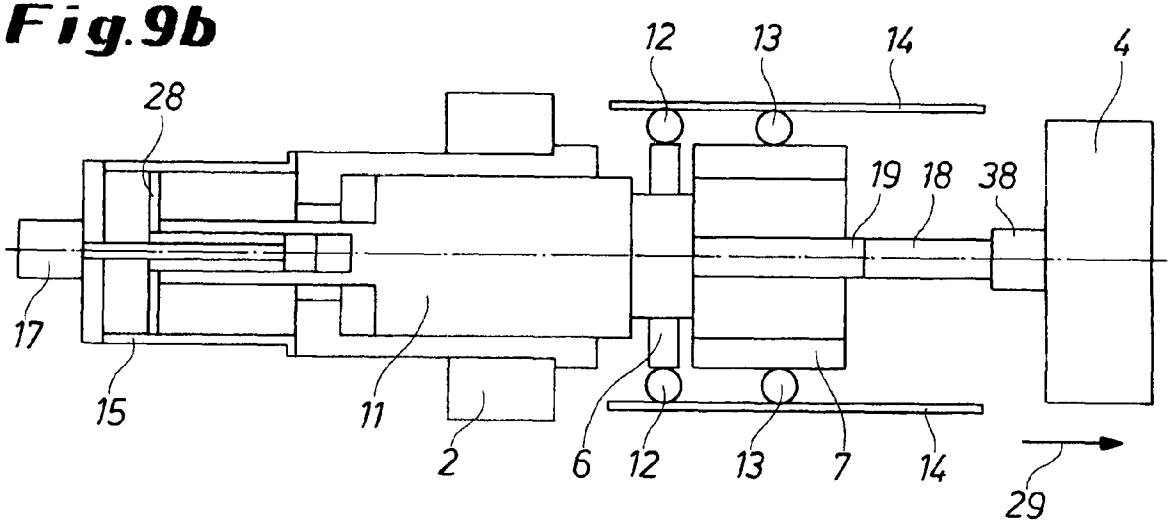
Figure 10A:
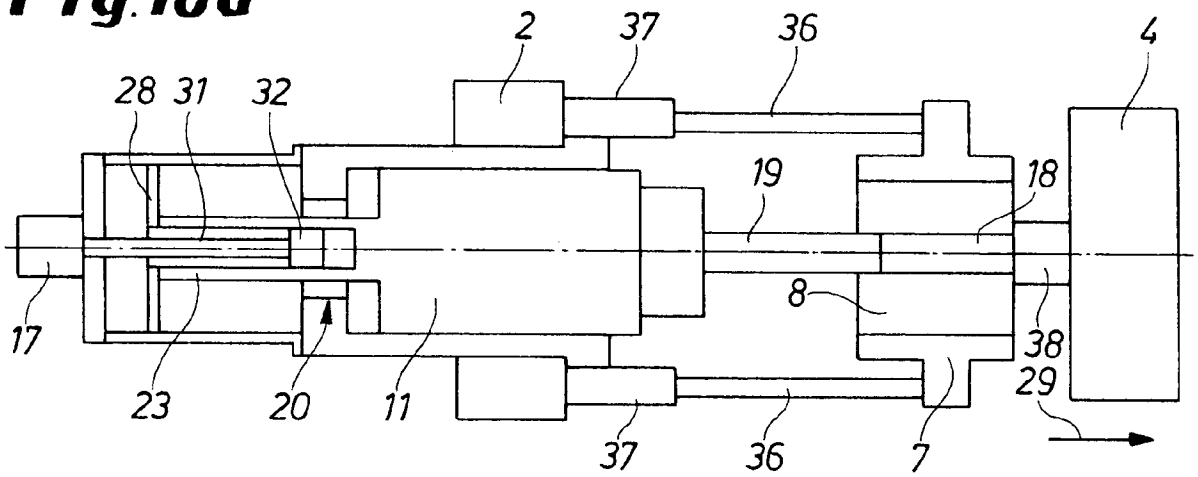
Figure 10B:
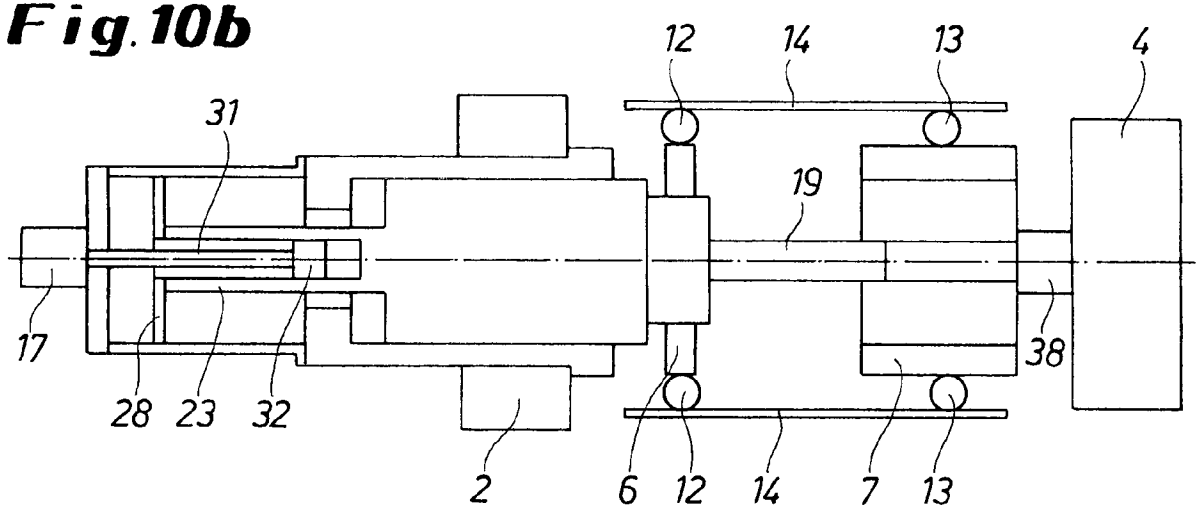
Figure 11A:
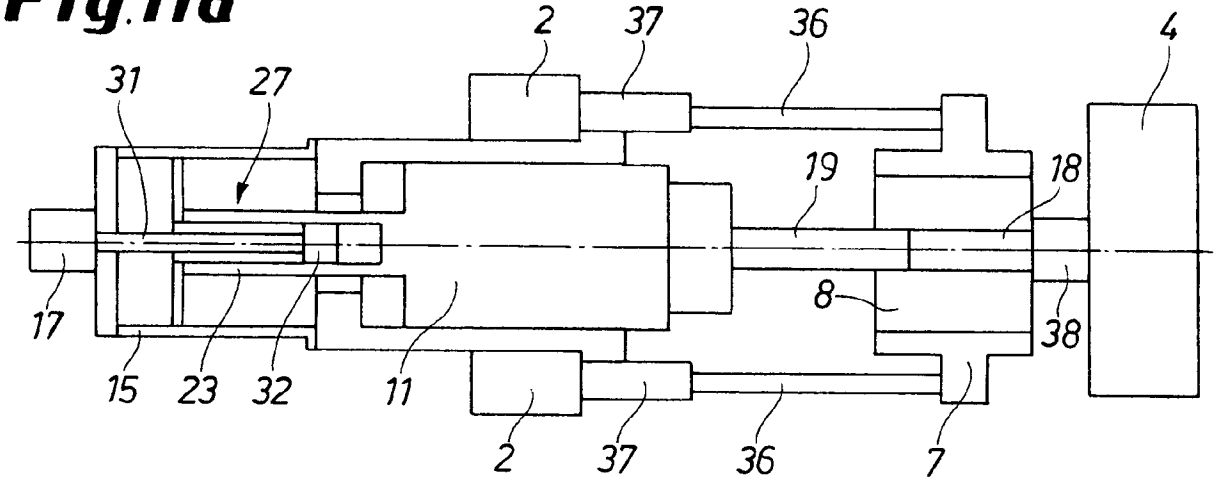
Figure 11B:
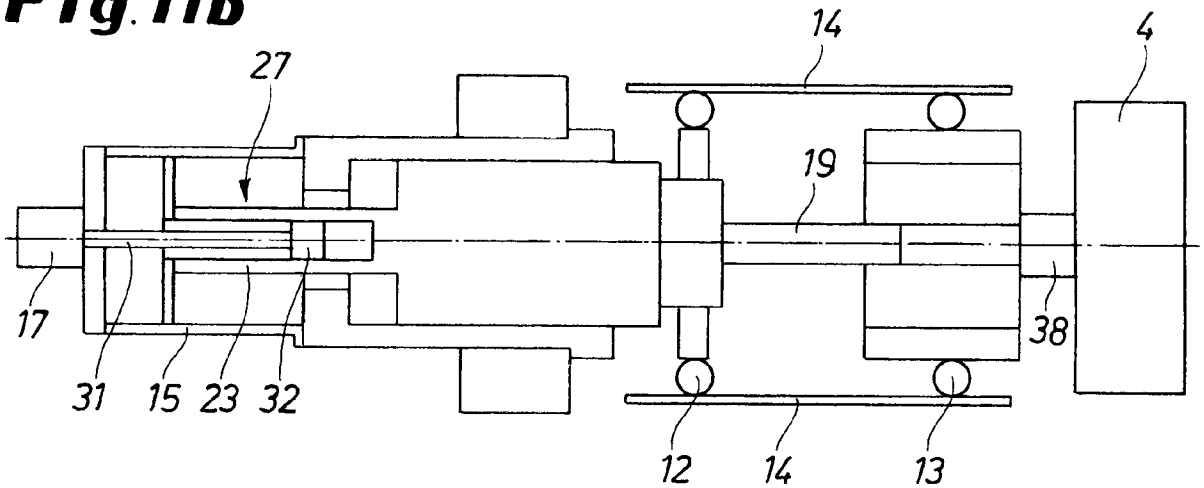
Figure 12A:
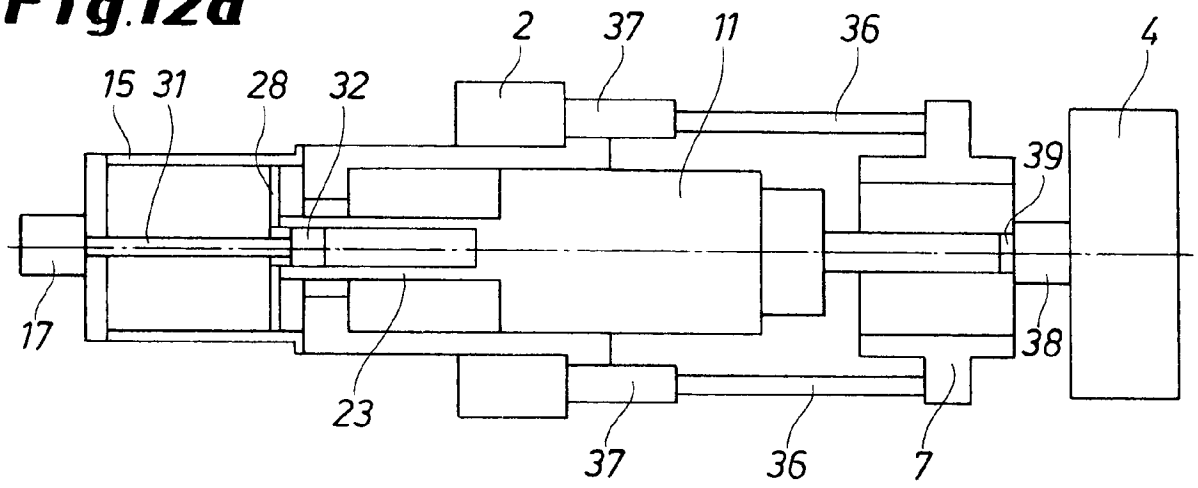
Figure 12B:
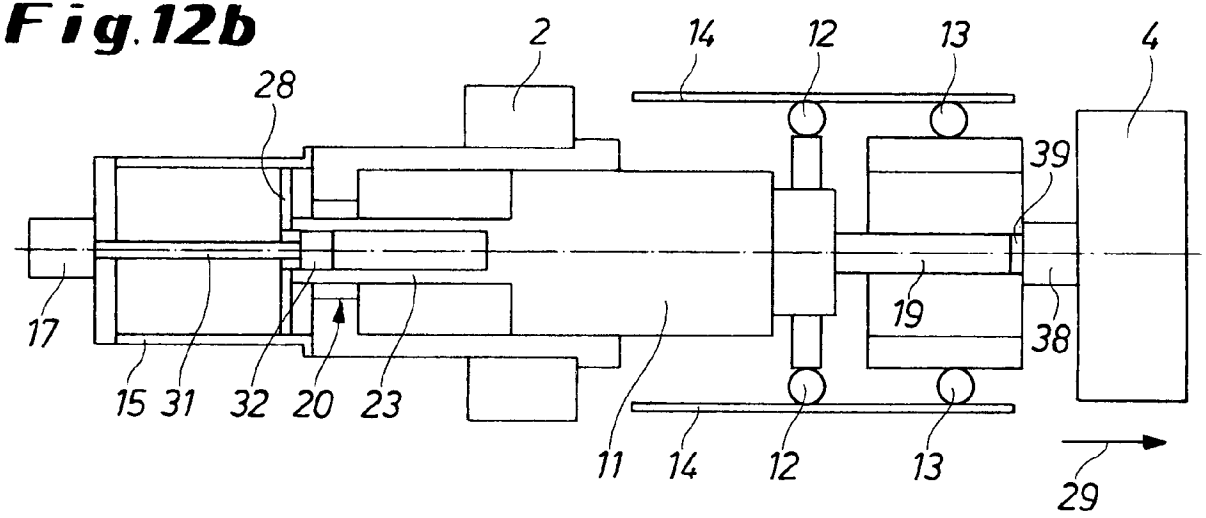
Figure 13A:
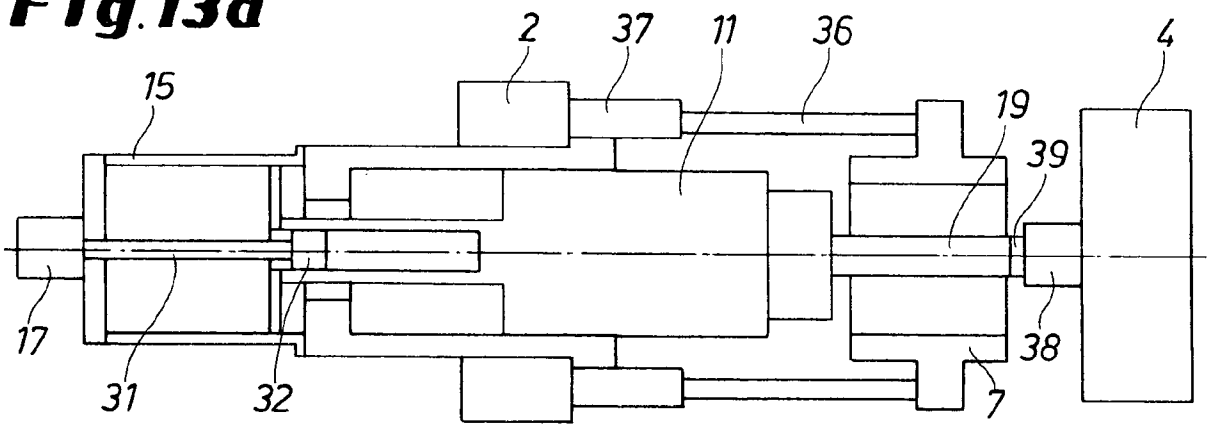
Figure 13B:
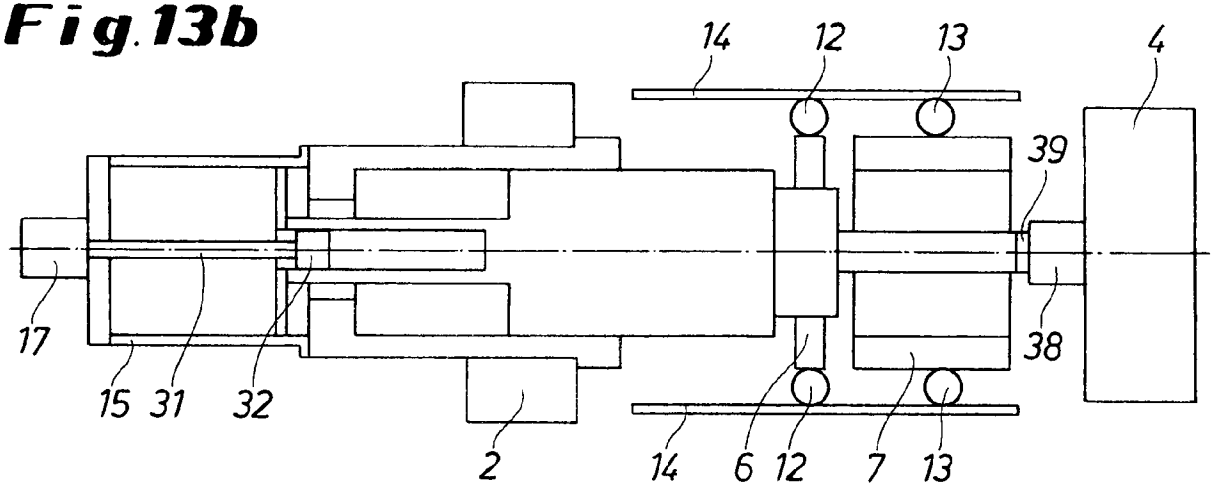
Figure 14A:
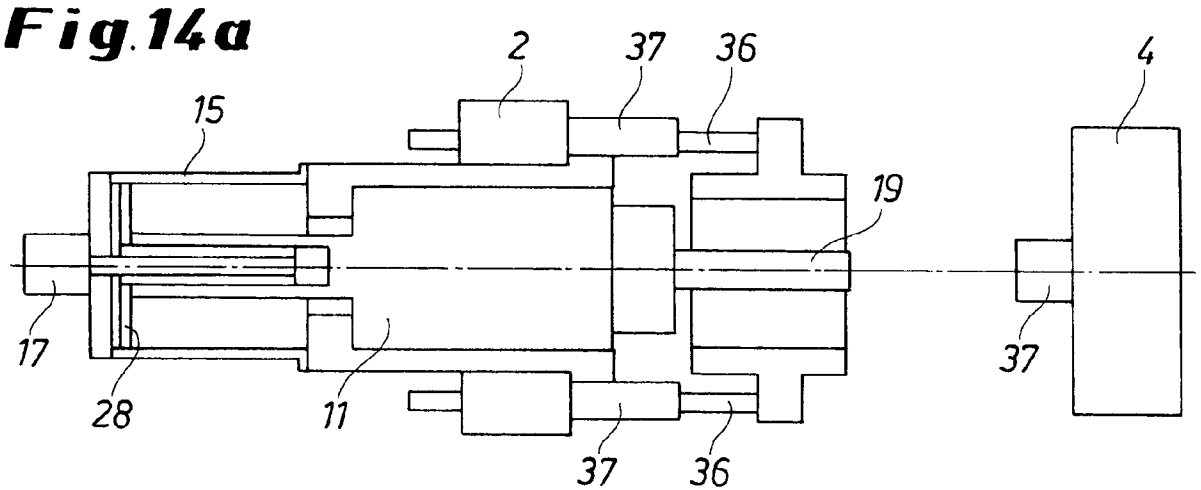
Figure 14B:
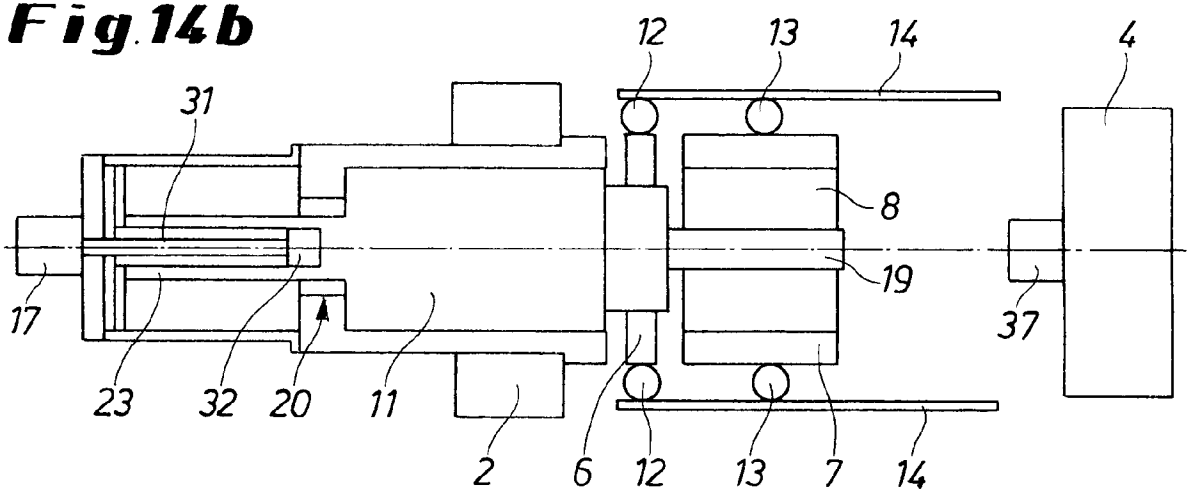

FIGS. 8*a* and 8*b* are a schematic side view (FIG. 8*a*) and a top view (FIG. 8*b*) of the press from FIG. 1 in the billet-loading position;

FIGS. 9*a* and 9*b* are a schematic side view (FIG. 9*a*) and a top view (FIG. 9*b*) of the press in the operating position for clamping a loaded billet to be pressed;

FIGS. 10*a* and 10*b* are a schematic side view (FIG. 10*a*) and a top view (FIG. 10*b*) of the press in the operating position with the billet support engaged around the billet to be pressed;

FIGS. 11*a* and 11*b* are a schematic side view (FIG. 11*a*) and a top view (FIG. 11*b*) of the press in the operating position for precompressing or compressing the billet;

FIGS. 12*a* and 12*b* are a schematic side view (FIG. 12*a*) and a top view (FIG. 12*b*) of the operating position when pressing the billet until reaching a residual extrusion butt length;

FIGS. 13*a* and 13*b* are a schematic side view (FIG. 13*a*) and a top view (FIG. 13*b*) of the operating position after exposing the extrusion butt; and FIGS. 14*a* and 14*b* are a schematic side view (FIG. 14*a*) and a top view (FIG. 14*b*) of the press retracted into the billet-loading position.

FIG. 1 essentially shows the basic frame of a metal extrusion/tube press 1. This structure has a cylinder housing 2 and a counter housing 4, not shown here, that is braced thereagainst and held in place by tension beams (see, for example FIG. 8*a*). Compression beams 5 further contribute to creating a closed force connection of these housings and surround the tension beams 3 between the cylinder housing 2 and the counter housing 4. The compression beams 5 further act as guides for a punch crosshead 6 and a billet support 7 that are movable in the basic frame. The billet support 7 includes a billet holder 8 and is moved with the punch crosshead 6 that supports a press piston 11 whose leading end is guided in the counter housing 4 [cylinder housing 2] inside a cylinder 9 in a hydrostatic bearing 10 (see FIGS. 2 to 4) by electric motors 12 and/or 13, particularly servo motors. The electric motors 12 and 13 are provided on each longitudinal side of the billet support 7 and the punch crosshead 6, respectively. Sprockets of the electric motors 12 and/or 13 mesh with racks 14 to transmit force and/or initiate movement. A compensation tank 15 is screwed to the rear end of the cylinder 9 of the cylinder housing 2, and a drive cylinder 17 is screwed to the rear end 16 of the compensation tank 15. The press piston 11 has a press punch 19 for compressing and pressing a billet 18 that has been loaded into the billet holder 8.

Figure 2:
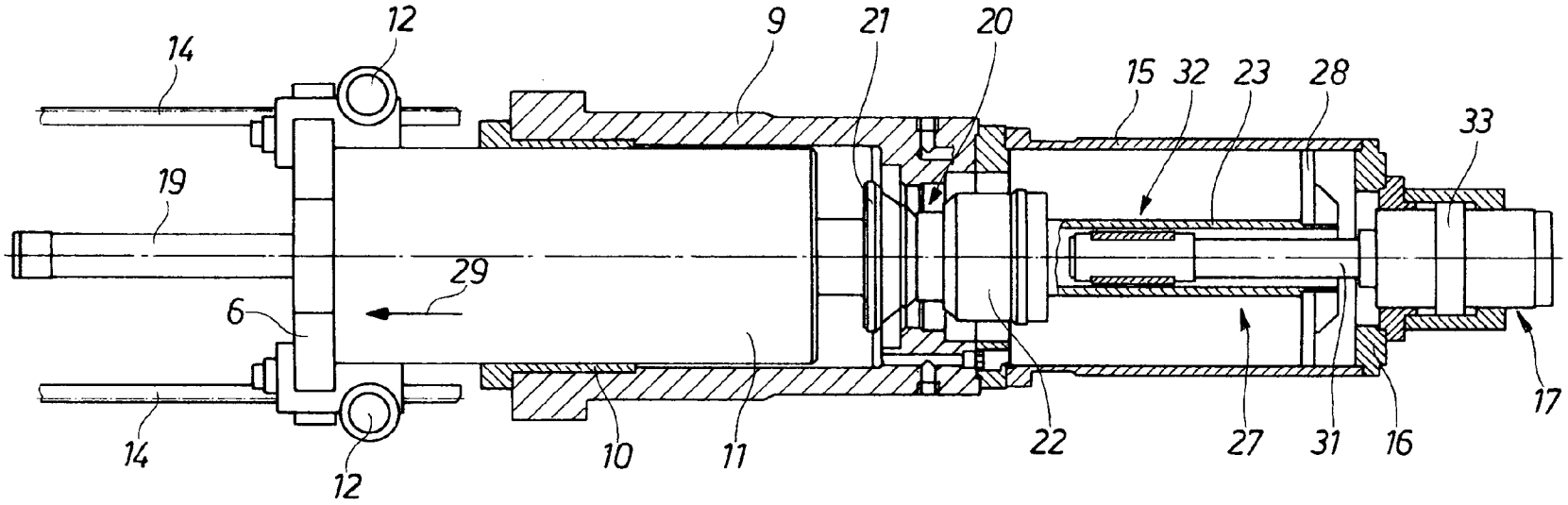
FIG. 2 is a partly sectional top view of the rear part of the press from FIG. 1 showing the cylinder of the main and/or press cylinder/s and the punch crosshead with electric motors and gear racks.
Figure 3:
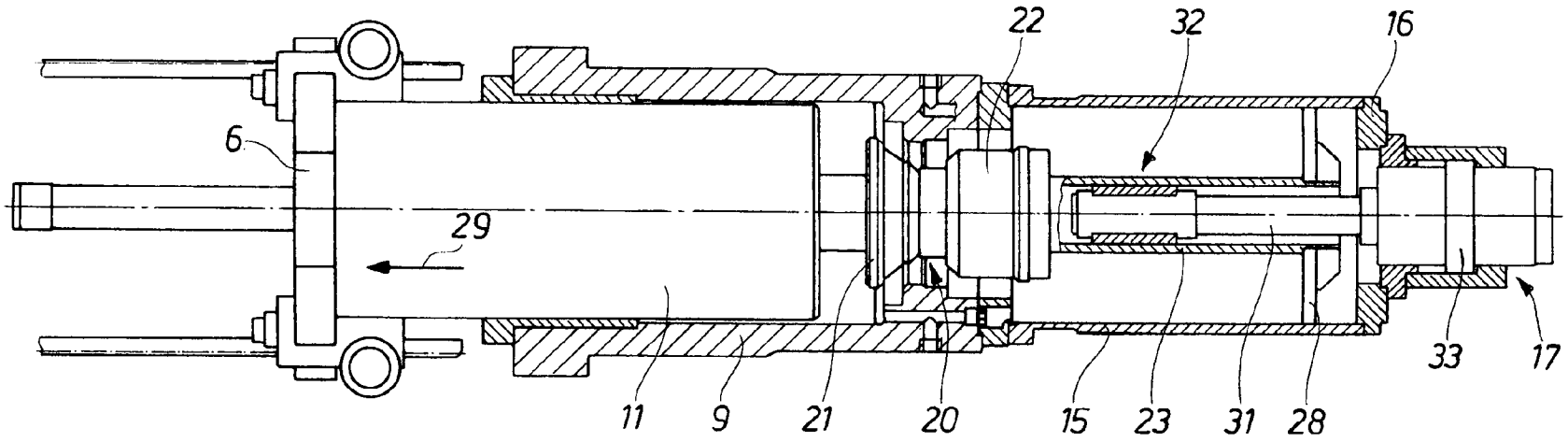
FIG. 3 is a top view like FIG. 2 shown during compression of the billet with the clamp engaged.
Figure 4:
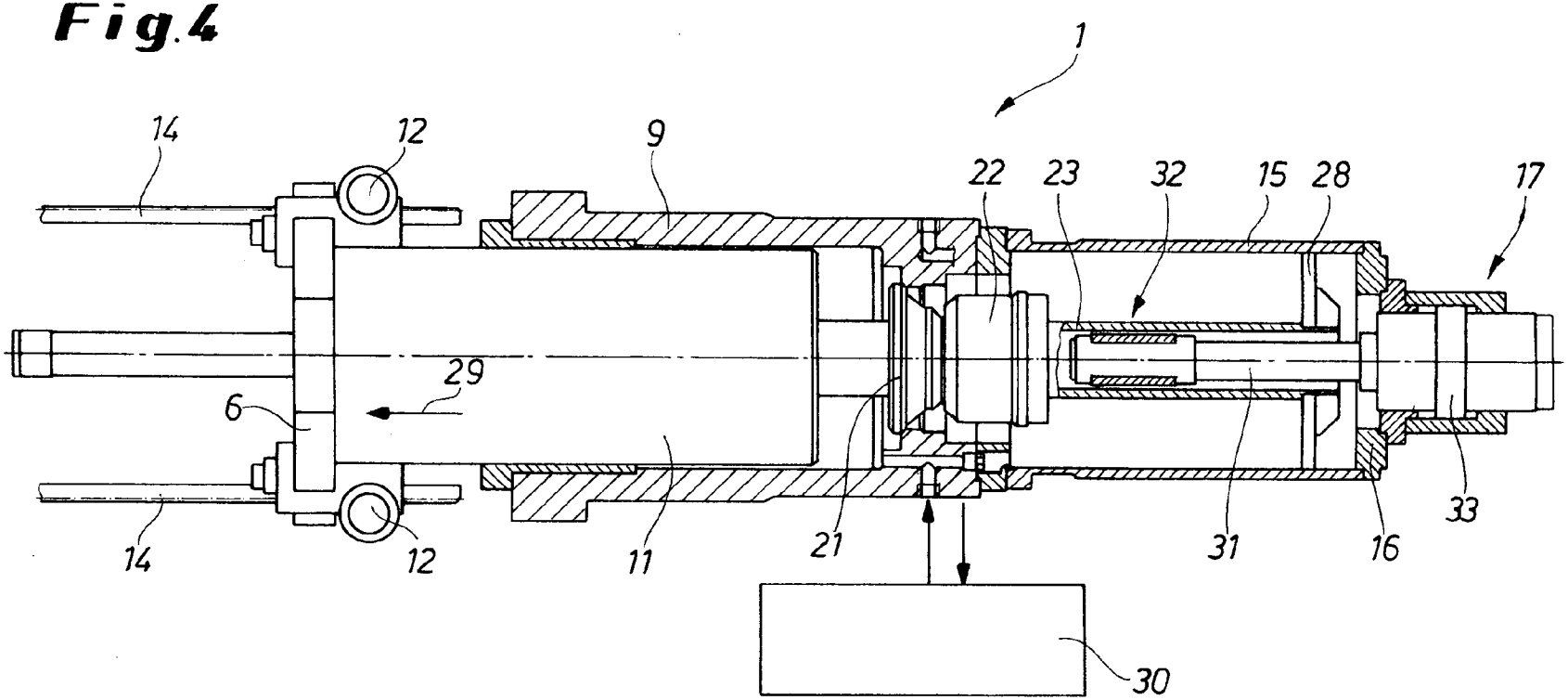
FIG. 4 is a view like FIG. 2 with the filling valve closed for press action.
Figure 5:
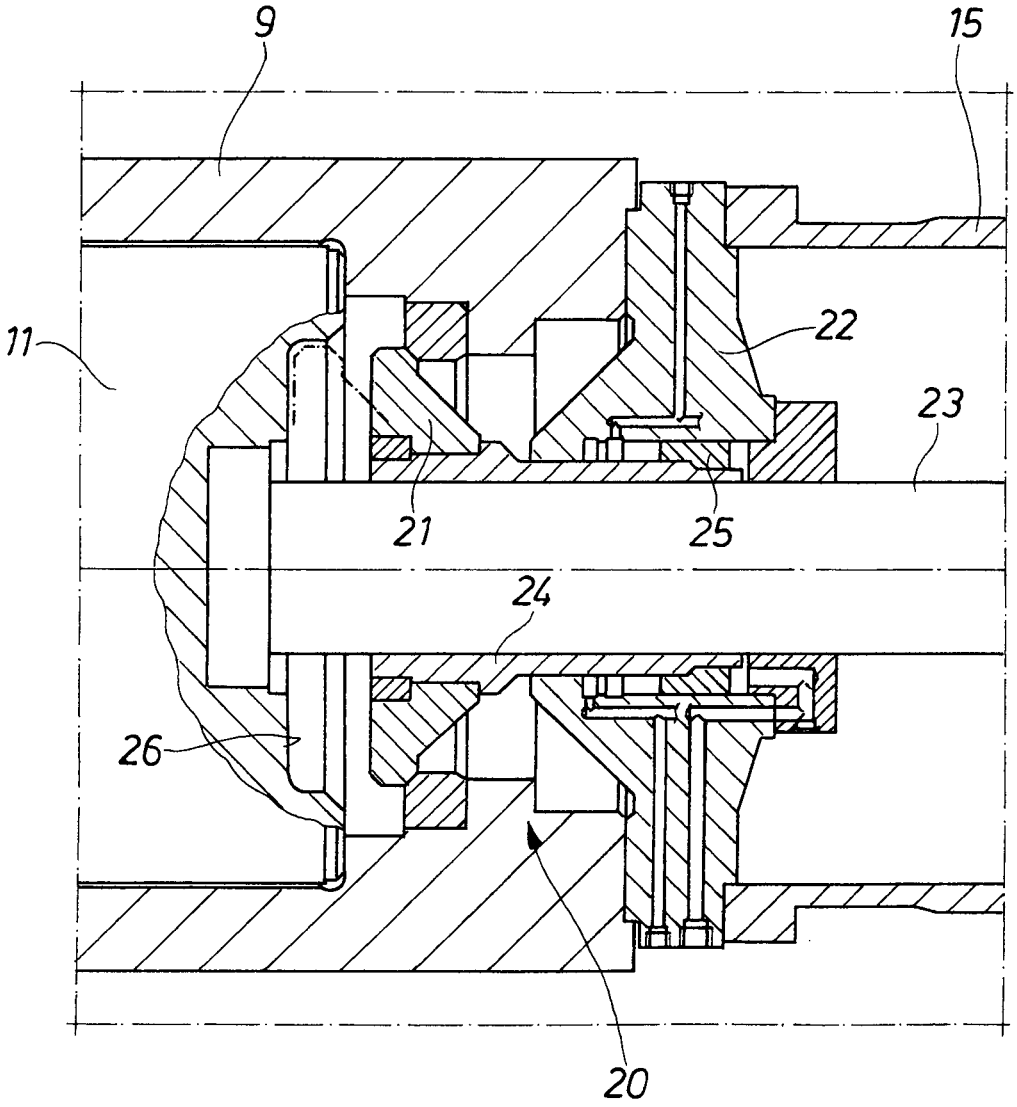
FIG. 5 is a sectional view of a detail from FIGS. 2 to 4 of the filling valve integrated in the cylinder and operable by a ring cylinder.

As shown in FIGS. 2 to 4, a central filling valve 20 integrated in the cylinder 9 of the main and/or press cylinder has a large-surface valve body 21 and a ring cylinder 22 for actuating the filling valve. The filling valve 20, which is shown in closer detail in FIG. 5, is on an outer tube 23 mounted on the rear end of the press piston 11 with a collar-like slide bushing 24 therebetween and on which the ring cylinder 22 is carried as well. When a ring piston 25 of the ring cylinder 22, which is shown on the rear end in FIG. 5, is acted on by hydraulic fluid, the slide bushing 24 and the fill-valve body 21 are moved from their closed position indicated by solid lines to the open position indicated by a dashed line and in which the fill-valve body 21 seats in a complementary recess 26 of the press piston 11. In the open position, a large flow cross-section and/or an annular gap is formed through which the hydraulic fluid is able to flow freely from the compensation tank 15 into the pressure chamber of the cylinder 9 behind the press piston 11—and vice versa—without encountering any significant resistance. To retract the fill-valve body 21 into the closed position, the ring cylinder 22 is reverse actuated in that hydraulic fluid passing via pressure lines now reaches the area in front of the ring piston 25, whereupon the slide bushing 24 and the fill-valve body 21 are retracted.

The outer tube 23 that supports the ring cylinder 22 with the fill-valve body 21 is here a component of a stem 27 that extends into the compensation tank 15 and is provided at its end with a slide plate 28 that pushes the hydraulic fluid when the press piston 11 is urged in the press direction of arrow 29 by the opened filling valve cover 28—as shown in FIGS. 2 and 3 in the open position—into the pressure chamber behind of the press piston 11 or, when the fill-valve body 21 is closed for the pressing step, as shown in FIG. 4, into a reservoir that is provided laterally of the press as indicated by the downward pointing arrow. The stem 27 further comprises a drive rod 31 that extends through the outer tube 23 and is connected with the drive cylinder 17 that is flange-mounted to the rear end and/or the end plate 16 of the compensation tank 15. The free end of the drive rod 31 is provided with a clamp 32 via which the drive rod 31 can press, if necessary, from the inside against the outer tube 23 to lock itself thereto for the purpose of compressing the billet, as shown in FIG. 3. The clamp 32 is engaged by the combined drive cylinder 17 in that the ring piston 33 thereof is correspondingly loaded.

Figure 6:
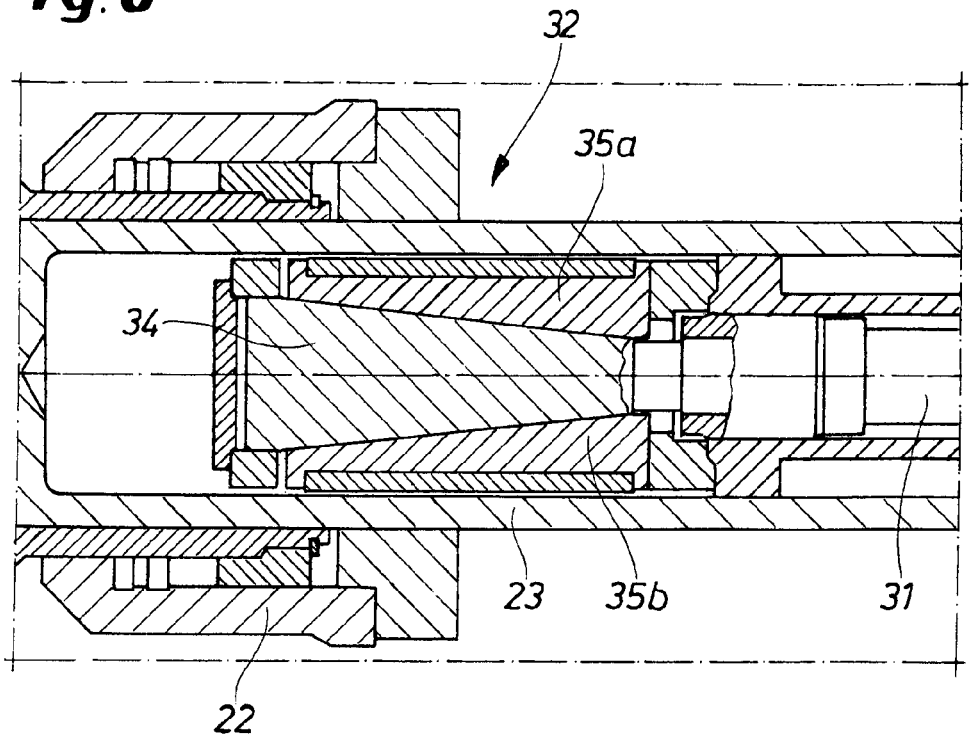
FIG. 6 is a cross-sectional view of a detail from FIGS. 2 to 4 of an embodiment of a clamp in the disengaged position.
Figure 7:
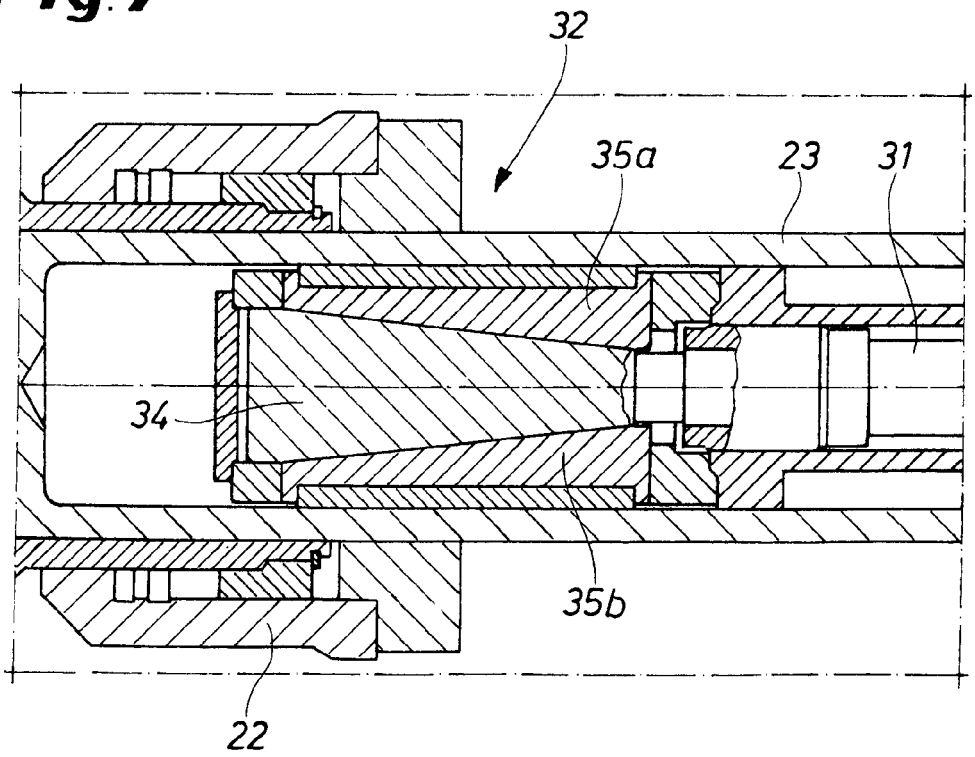
FIG. 7 is a view of the clamp from FIG. 6 in the engaged position.

In a configuration of the clamp 32 as shown in FIGS. 6 and 7, the clamp includes a central cone 34 that is screwed to the drive rod 31, and complementary wedges 35*a* and 35*b*. When the clamp 32 is not engaged (see FIG. 6), the central cone 34 is pushed forward to the front, in the drawing on the left. When the clamp 32 is then engaged via the drive cylinder 17 (see FIG. 7), the drive cylinder 17 pulls the spline 34 as seen in the drawing to the right such that the complementary wedges 35*a* and 35*b* are pressed against the inside wall of the outer tube 23.

The mode of operation of the extrusion/tube press 1 that operates by a combination of electrical and hydraulic means will be described in further detail below with reference to FIGS. 8*a* and 8*b* to FIGS. 14*a* and 14*b*. FIGS. 8*a* and 8*b* show the billet-loading position in which the billet 18 that is to be pressed has been moved by a standard billet loader into the center of the extrusion/tube press 1. As can be seen in further clear detail therein, aside from the already described parts, the extrusion/tube press 1 has support rods 36 flanking the billet support 7, preferably on each side and at the top as well as the bottom, and extending with their free ends with freedom of movement through the cylinder housing 2 (see also FIG. 1). A combined ring cylinder and clamps 37 are provided for the support rods 36 on the cylinder housing 2. When in the billet-loading position, all moving parts are in the retracted starting position remote from the counter housing 4.

With regard to clamping of the billet 18 loaded between the press punch 19 and the tool and/or tool set 38 of the counter housing 4, as shown in FIGS. 9*a* and 9*b*, the billet support 7 and the punch crosshead 6 are advanced along with the press piston 11 and the press punch 19 by the respective electric motors 12 and 13 in the press direction 29, while the filling valve 20 (see. FIG. 2) is open and a first quantity of hydraulic fluid is pulled out of the compensation tank 15 and into the pressure chamber behind the press piston 11. The now clamped billet 18 is moved into the billet holder 8 by advance of the billet support 7 via the electric motors 13, as shown in FIGS. 10*a* and 10*b* and the support rods 36 are pulled along when the ring-cylinder clamp 37 is not engaged. To lock the billet holder 8 to the tool set 37, the ring-cylinder clamps 37 are now engaged, and the billet support 7 and the billet holder 8 are moved against the tool 37 [38].

The subsequent compression and/or precompression action of the billet 18 is shown in FIGS. 11*a* and 11*b*. To this end, the electric motors 12 and 13 are disengaged, the drive cylinder 17 is pressurized and the clamp 32 engaged so that the drive rod 31 is locked to the outer tube 23. The drive cylinder 17 then pushes via the rigid stem 27 comprised of the drive rod 31 and the outer tube 23 against the press piston 11 such that a second quantity of hydraulic fluid pulled through the open filling valve in this compression position (see FIG. 3) into the pressure chamber behind of the press piston 11. The subsequent pressing action of the billet, save for a remaining extrusion butt 39 that is left behind, is shown in FIGS. 12*a* and 12*b*. The clamp 32 is disengaged for the pressing operation, and the valve body 21 of the integrated filling valve 20 is retracted by the ring cylinder 22 into the sealing closed position in the cylinder 9, as shown in FIG. 4. The pressing force is generated by feeding hydraulic fluid from the reservoir 30, as indicated by the upward arrow in FIG. 4, into the pressure chamber behind of the press piston 11. Since the filling valve 20 is closed and the clamp 32 is disengaged the press piston 11 will move in the press direction 29, the slide plate 28 of the outer tube 23 will pull a third quantity of hydraulic fluid out of the compensation tank 15, and this third quantity of hydraulic fluid will flow into the reservoir 30 (see FIG. 4).

The ring-cylinder clamps 37 are released to expose the extrusion butt 39, such that it can be sheared off by the billet holder 8. The billet support 7 is retracted by the clamped support rods 36 through a distance equal to the length of the extrusion butt 39. This stripping end position of the extrusion butt 39 is shown in FIGS. 13*a* and 13*b*.

To prepare a new loading and pressing process, the billet support 7 and the punch crosshead 6 are retracted by the electric motors 12 and 13 with the filling valve 20 open such that hydraulic fluid can flow from the chamber behind the press piston into the compensation tank 15, the clamp 32 is disengaged, and the ring cylinder and clamps 37 are disengaged as well, as shown in FIGS. 14*a* and 14*b*, whereupon the extrusion/tube press 1 is available for a new work cycle.

List of reference numbers:

| | |
|---|---|
| 1 | Extrusion/tube press/metal extrusion press |
| 2 | Cylinder housing |
| 3 | Tension beam |
| 4 | Counter housing |
| 5 | Compression beam |
| 6 | Punch crosshead |
| 7 | Billet support |
| 8 | Billet holder/recipient |
| 9 | Main cylinder/main cylinder |
| 10 | Hydrostatic support |
| 11 | Press piston |
| 12 | Electric motor/servo motor |
| 13 | Electric motor/servo motor |
| 14 | Gear rack |
| 15 | Compensation tank |
| 16 | End wall/rear wall |
| 17 | Drive cylinder |
| 18 | Billet |
| 19 | Press punch |
| 20 | Filling valve |
| 21 | Fill-valve body/valve cover |
| 22 | Ring cylinder |
| 23 | Outer tube |
| 24 | Slide bushing |
| 25 | Ring piston |
| 26 | Recess |
| 27 | Stem |
| 28 | Slide plate |
| 29 | Press direction/arrow |
| 30 | Reservoir |
| 31 | Drive rod |
| 32 | Clamp |
| 33 | Ring piston |
| 34 | Spline |
| 35a and 35b | Complementary wedge |
| 36 | Support rod |
| 37 | Combined ring cylinder/clamp |
| 38 | Tool/tool set |
| 39 | Extrusion butt |
| 40 | |

The invention claimed is:

1. An extrusion press comprising:

a press frame having a main housing and a counter housing fixedly spaced therefrom, the counter housing being adapted to carry an extrusion die;

guides extending longitudinally between the main housing and the counter housing;

a billet support longitudinally shiftable between the main housing and the counter housing;

a billet holder on the billet support adapted to hold a billet;

a crosshead riding on the guides and displaceable between a starting end position juxtaposed with the main housing and a final end position spaced toward the counter housing from the starting end position, and through an intermediate position therebetween;

a piston-and-cylinder unit carried on the crosshead and longitudinally hydraulically extensible between an extended condition and a shortened condition;

a punch carried on the piston-and-cylinder unit, a longitudinal spacing between the crosshead and the extrusion die being such that, in the starting position of the crosshead and shortened condition of the piston-and-cylinder unit, the billet can be loaded between the punch and the extrusion die, and in the intermediate position of the crosshead and shortened condition of the piston-and cylinder unit, the loaded billet is longitudinally clamped between the punch and the extrusion die, and movement of the piston-and-cylinder unit from the shortened condition to the elongated condition in the intermediate position of the crosshead pushes the billet through the extrusion die with the punch;

electric motors for longitudinally shifting the crosshead from the starting position to the intermediate position for shifting the billet into engagement with the extrusion die; and means for hydraulically pressurizing the piston-and-cylinder unit in the intermediate position for pushing the billet through the extrusion die.

2. The extrusion press defined in claim 1, further comprising:

a compensation tank having a rear wall, holding hydraulic fluid, and connected to a main cylinder of the piston-cylinder unit; and a stem that extends in the compensation tank to a drive cylinder mounted on the rear wall of the compensation tank, hydraulically loaded for the purpose of precompressing the billet, and having a filling valve disposed in the transition from the compensation tank to the main cylinder and adjusted to the internal diameter of the main cylinder such that, when the filling valve is open, the filling valve increases an annular flow cross-section to the compensation tank.

3. The extrusion press defined in claim 2, further comprising a stem that connects a press piston to the drive cylinder that has an outer tube that supports on an opposite free end a slide plate and also a drive rod that is connected in the rear on the drive cylinder, and that engages into the outer tube, the engaged end of the drive rod being provided with a clamp that must be temporarily pressed against the outer tube.

4. The extrusion press defined in claim 3, wherein the clamp includes a central cone that presses complementary wedges against the interior wall of the outer tube when the drive cylinder is pressurized.

5. The extrusion press defined in claim 2, wherein the filling valve has a fill-valve body mounted on the outer tube via a collar-like slide bushing, a ring cylinder that encloses the slide bushing in the press direction behind the valve body, and a ring piston that brings the slide bushing, and thereby the valve body, depending on the piston side to which the hydraulic fluid load is applied, into a closed position or into an open position.

6. The extrusion press defined in claim 1, wherein the electric motors are each provided on a respective longitudinal side of the billet support and engaged with a respective rack of the punch crosshead.

7. The extrusion press defined in claim 1, wherein the electric motors are servo motors.

8. The extrusion press defined in claim 3, wherein the drive cylinder is configured such that, when the clamp is activated, it generates the force for compressing the billet with the drive rod.

9. The extrusion press defined in claim 1, wherein the billet support has on each longitudinal side at least one support rod that passes longitudinally through the piston-and cylinder unit in a freely mobile fashion and, over a partial length between the piston-and-cylinder unit and the billet support, the support rods are enclosed by a combined ring cylinder housing and clamp.

* * * * *